United States Patent [19]

Jarvis et al.

[11] Patent Number: 4,822,241

[45] Date of Patent: Apr. 18, 1989

[54] AUTOMATIC DISHWASHER WITH A PUMP HAVING A SELECTIVELY ADJUSTABLE IMPELLER CLEARANCE

[75] Inventors: Wilbur W. Jarvis, St. Joseph Township, Berrien County; John I. Smith, Coloma Township, Berrien County, both of Mich.

[73] Assignee: Whirlpool Corporation, Benton Harbor, Mich.

[21] Appl. No.: 80,607

[22] Filed: Aug. 3, 1987

[51] Int. Cl.[4] ..... F01D 5/12

[52] U.S. Cl. ..... 415/132; 415/104; 415/126; 415/129

[58] Field of Search ..... 415/126, 129, 131, 132, 415/104, 106, 107, 170 R, 189, 34

[56] References Cited

U.S. PATENT DOCUMENTS

| | | | |
|---|---|---|---|
| 1,844,829 | 2/1932 | Wintroath | 415/131 |
| 1,856,610 | 5/1932 | Wintroath | 415/131 |
| 1,972,548 | 9/1934 | Brady, Jr. | 415/132 |
| 3,088,416 | 5/1963 | Danis | 415/132 |
| 3,216,361 | 11/1965 | Leff | 415/132 |
| 3,272,137 | 9/1966 | Maitten et al. | 415/131 |
| 3,906,967 | 9/1975 | Bergeson | 415/121 G |
| 4,057,361 | 11/1977 | Renaud | 415/131 |
| 4,753,570 | 6/1988 | Jarvis | 415/146 |

*Primary Examiner*—Robert E. Garrett
*Assistant Examiner*—John T. Kwon
*Attorney, Agent, or Firm*—Mason, Kolehmainen, Rathburn & Wyss

[57] ABSTRACT

An automatic dishwasher includes a cabinet enclosing an interior washing chamber with a pump mounted in the cabinet for pumping liquids into and out of the washing chamber. The pump includes a housing having spaced apart walls and a rotatable motor shaft extending into the housing from a first one of the walls. A rotatable impeller is mounted for longitudinal movement along the motor shaft and is keyed to rotate with the motor shaft between the spaced apart walls of the housing. A removable bearing mount that supports a thrust bearing is threaded into the pump housing and, with the thrust bearing, provides an axial stop for limiting the movement of the impeller along the motor shaft. The bearing mount also includes an annular surface disposed near the exposed edges of the blades of the impeller and spaced therefrom by a predetermined, desired clearance or gap. The optimization of the clearance maximizes the efficiency of the pump. This clearance is automatically provided in a final pump assembly step when the bearing mount is threaded into place in engagement with the pump housing.

17 Claims, 3 Drawing Sheets

10
12
14
16
18
20
22
28
30
32
34
36
2

80c
80e
80f
82a
82
80d
82b 40
40a
65
65a
42a 78
20
24
A
80g
80c
80
80d
3
54b
84
82
54d
80a
54
56
54a
28
22
48
38
46
36
44
45
77
74
72
70
68
76
42d
58
50
52a
52
40
66
65
42
80b
40A
2B
2A
42e
54c
B

AUTOMATIC DISHWASHER WITH A PUMP HAVING A SELECTIVELY ADJUSTABLE IMPELLER CLEARANCE

CROSS REFERENCE TO RELATED APPLICATION

The invention disclosed and claimed in this application is related to the subject matter disclosed and claimed in a copending, commonly assigned, United States patent application Ser. No. 918,709, filed on Oct. 14, 1986, for a BI-DIRECTIONAL PUMP WITH DIAPHRAGM OPERATED VALVE FOR DISHWASHER by Wilbur Jarvis, which copending application is incorporated herein by reference for all purposes.

BACKGROUND OF THE INVENTION

A. Field of the Invention

The present invention generally relates to automatic dishwashers and, more particularly, to a new and improved dishwasher having a highly efficient pump for pumping washing and rinsing liquids into and out of a washing chamber of the dishwasher.

B. Description of the Prior Art

Automatic dishwashers are old and well known in the prior art. It is also well known to use a bi-directional pump in automatic dishwashers wherein operation of the pump impeller in one direction directs washing and rinsing liquids into the washing chamber and operation in an opposite direction discharges the waste liquids through a drain line running out of the dishwasher cabinet. Centrifugal pumps having dual outlets for use in dishwashers are disclosed in U.S. Pat. No. 2,838,002 to Cohen and U.S. Pat. No. 2,883,843 to Bochan.

Other prior art patents are also of interest. For example, the Luenberger U.S. Pat. No. 2,633,392 discloses a thrust bearing for a shaft of a pump impeller. The Killane U.S. Pat. No. 3,323,650 discloses a rotary pump for a marine chlorinator wherein the impeller assembly of the pump is assembled through the inlet of the pump housing. The Blum U.S. Pat. No. 3,347,475 discloses a centrifugal pump having an impeller with a circular impeller plate and spirally extending blades of tapered thickness joined integrally therewith. The Bassani U.S. Pat. No. 3,680,826 discloses a cup-shaped sealing member of resilient flexible material which is securable to a peripheral wall and extends sealingly into the open side of a hollow access box to prevent intrusion of liquid into the interior of the box.

The Smith et al U.S. Pat. No. 3,810,480 discloses a dishwasher having a reversible, dual cavity pump assembly wherein the output of one cavity is in communication with a fluid distribution system and the output of the other cavity is in communication with an external drain conduit. The Spiegel et al U.S. Pat. No. 3,854,762 discloses a dishwasher having a rotary handle door latch for sealing the opening of a cabinet of a front loading dishwasher. The Hahn et al U.S. Pat. No. 3,981,456 discloses a dishwasher having a pal, such as polypropylene. The housing 50 includes an inner half or section 52 disposed adjacent to the motor 36 and an outer half or section 54 securely joined thereto, for example, by a heat sealing peripheral joint 56. Together the housing sections 52 and 54 form an involute pump chamber 58 (FIG. 2) about the rotatable impeller 42. The pump housing 50 has a first, relatively large, tangentiaa recirculating pump for swimming pool water; and the Meyers U.S. Pat. No. 4,448,359 discloses a combination drain pump and grinder for use in a dishwasher.

Although dishwashers commonly include a centrifugal type pump for pumping washing and rinsing liquids into and out of a washing chamber, to applicant's knowledge none includes a pump having both an impeller which is mounted for free-floating longitudinal sliding movement on a motor driven shaft so that the impeller may be readily inserted into the pump housing through the inlet opening of the pump and a bearing mount removably disposed within the inlet opening of the pump to provide a closure wall spaced apart from the impeller by a desired clearance or gap to provide for maximum pump efficiency. Such a structure would facilitate both the initial pump assembly and its disassembly during maintenance or repair operations.

OBJECTS OF THE PRESENT INVENTION

An object of the present invention is to provide a new and improved automatic dishwasher and, more particularly, a new and improved automatic dishwasher having a liquid pump provided with a precise impeller clearance for maximum pump efficiency.

Another object of the present invention is to provide a new and improved automatic dishwasher pump having an impeller that is keyed to rotate with a motor driven shaft and is mounted for free-floating longitudinal movement thereon.

Another object of the present invention is to provide a new and improved method of assembling an automatic dishwasher pump wherein the final positioning of a bearing mount in the inlet opening of the pump housing determines the clearance between the impeller and a closure wall on the bearing mount, thus resulting in an extremely efficient pump assembly.

Another object of the present invention is to provide a new and improved method of disassembly for maintenance or repair purposes of an automatic dishwasher pump wherein component parts inside the pump housing are easily removed from the inlet side of the pump housing.

BRIEF SUMMARY OF THE INVENTION

The present invention concerns a new and improved automatic dishwasher having a cabinet enclosing an interior washing chamber and a pump mounted in the cabinet for pumping liquids into and out of the washing chamber. The pump includes a pump housing and a rotary impeller mounted on a motor driven shaft that extends into the housing. The rotary impeller is keyed to rotate with the shaft and, during assembly, is freely slidable in a longitudinal direction along the shaft for rapid and easy insertion in the pump housing through an enlarged opening on an inlet side of the pump.

After assembly of the impeller on the shaft, the opening is partially closed by a bearing mount to form a reduced size axial inlet to the pump chamber. The bearing mount includes an integral annular closure wall for disposition adjacent to the rotating impeller. The bearing mount determines the clearance or gap between the impeller and the closure wall to maximize the pump efficiency. The bearing mount supports a thrust bearing for supporting an outer end portion of the impeller shaft and for providing a thrust limiting stop surface for the impeller when the bearing mount is secured in place, thereby providing the desired impeller clearance or gap.

BRIEF DESCRIPTION OF THE DRAWINGS

The foregoing and other objects and advantages and novel features of the present invention will become apparent from the following detailed description of a preferred embodiment of the invention illustrated in the accompanying drawing, wherein.

DESCRIPTION OF THE PREFERRED EMBODIMENT OF THE INVENTION

Figure 1:
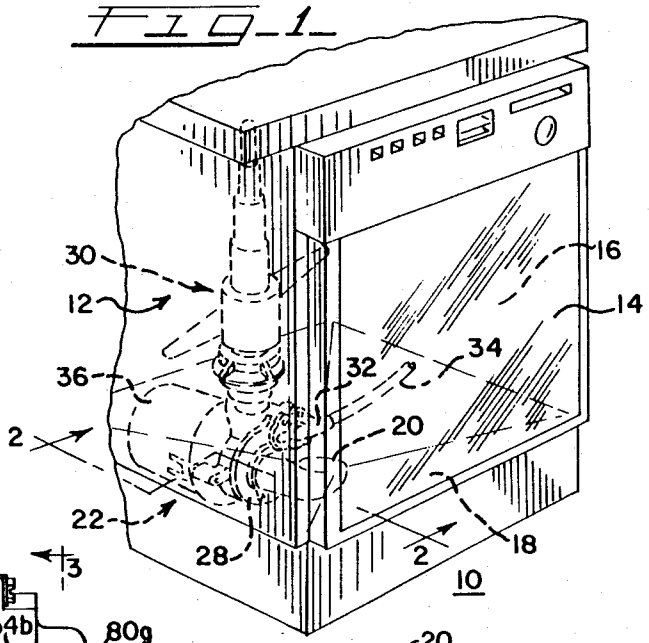
FIG. 1 is a front perspective view of a new and improved automatic dishwasher having a new and improved pump constructed in accordance with the principles of the present invention.

Referring to the drawing, there is illustrated a new and improved automatic dishwasher 10 constructed in accordance with the principles of the present invention. The dishwasher 10 includes a freestanding cabinet 12 of generally rectangular shape having an access door 14 to provide access to an interior washing chamber 16. The chamber 16 has a lower wall or floor 18 with sections sloping downwardly and inwardly toward a central sump or liquid drain 20 for directing (arrow A) washing and rinsing liquids to the inlet of a motor driven pump assembly 22 (FIG. 2) via a flexible inlet hose 24.

Figure 5:
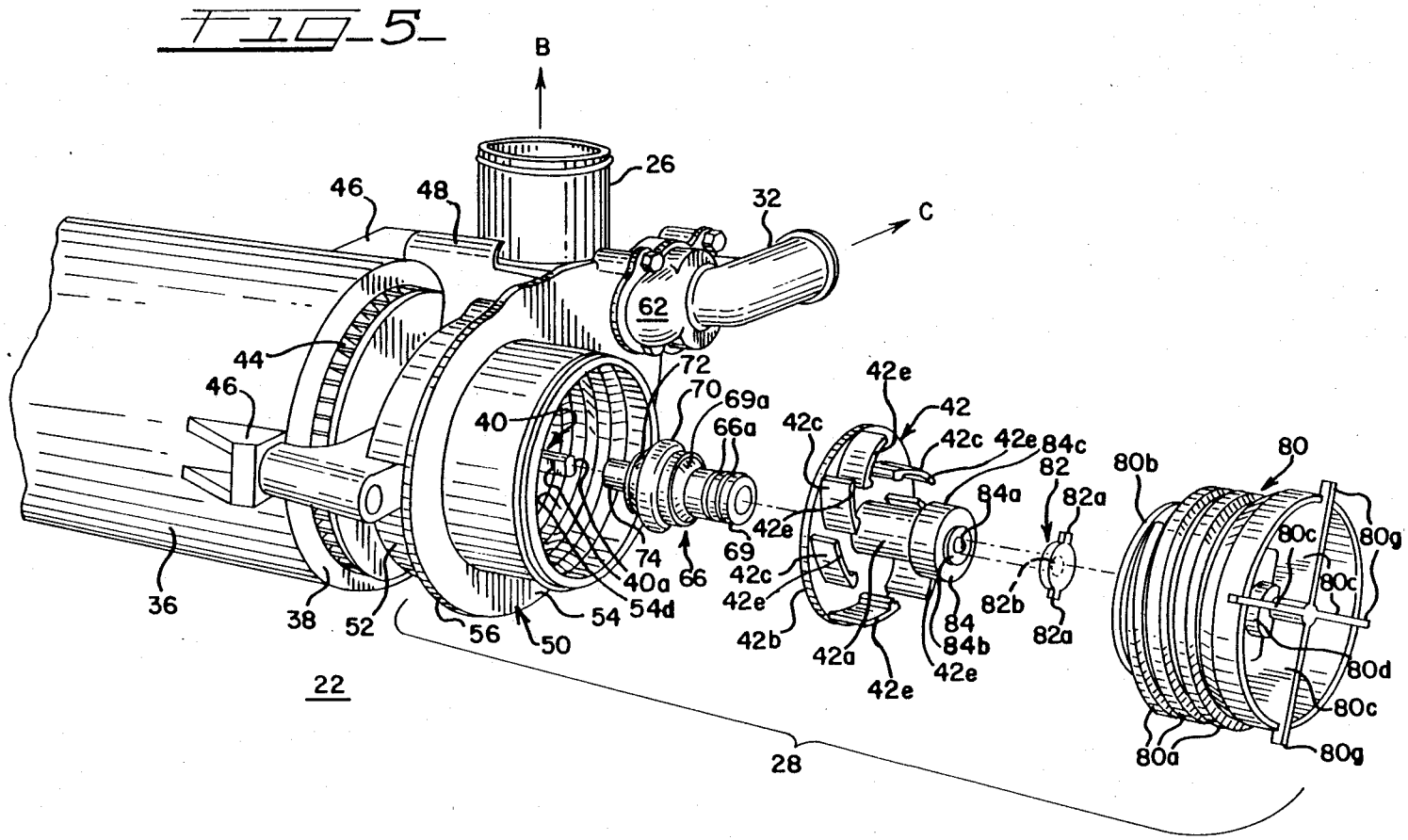
FIG. 5 is an enlarged, exploded, perspective view of the pump assembly of FIG. 1.

In one mode of operation, the pump assembly 22 pumps washing or rinsing liquids from the sump 20 in the lower portion of the washing chamber 16 upwardly (arrow B, FIGS. 2, 3 and 5) under pressure through an outlet 26 of a centrifugal liquid pump 28. The liquids are pumped into the lower end of an upstanding column of a rotary spray arm assembly 30 centrally located in the washing chamber 16.

In a second operating mode, waste liquids received by the pump 28 from the sump 20 via the inlet conduit 24 are discharged out an alternative, discharge outlet 32 of the pump 28 into a flexible drain hose or conduit 34 extending outwardly of the cabinet 12.

The motor driven pump assembly 22 (FIG. 2) includes a reversible electric motor 36 having a casing or enclosure with a front wall or face 38 and an output motor shaft 40 extending outwardly of the face 38 and drivingly interconnected with the pump 28 for rotating an impeller 42 mounted on an outer end portion of the shaft 40. A cooling fan 44 is also mounted on the shaft 40 outwardly of the face 38 to provide air circulation for cooling the motor 36.

The motor 36 and the pump 28 are detachably interconnected and maintained in coaxial alignment by a plurality of conventional fasteners 45 that securely interconnect a plurality of channel shaped brackets 46 spaced apart around the periphery of the motor casing and a plurality of mating legs 48 formed on a housing 50 of the pump 28. The housing 50 is preferably formed from a strong, lightweight, corrosion resistant molded resinous plastic material, such as polypropylene. The housing 50 includes an inner half or section 52 disposed adjacent to the motor 36 and an outer half or section 54 securely joined thereto, for example, by a heat sealing peripheral joint 56. Together the housing sections 52 and 54 form an involute pump chamber 58 (FIG. 2) about the rotatable impeller 42. The pump housing 50 has a first, relatively large, tangential outlet section **58*a* (FIG. 3) in communication with the large outlet 26 and a second, relatively small outlet chamber 58*b* in communication with the drain outlet 42** as more fully described in detail in the aforementioned copending and commonly assigned U.S. patent application.

Figure 4:
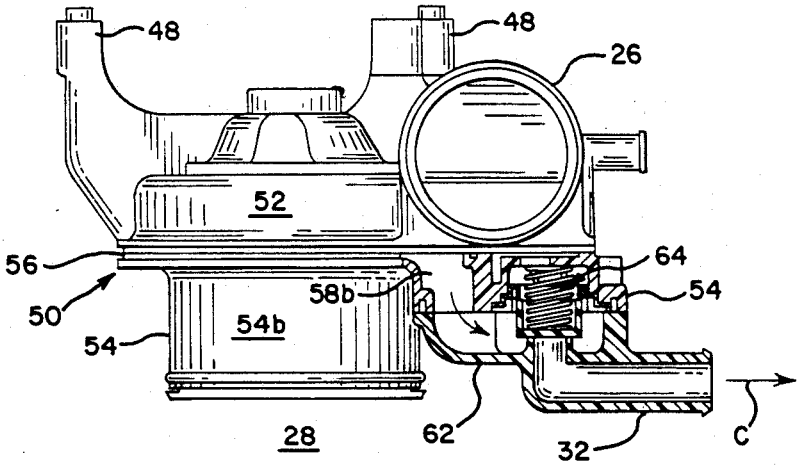
FIG. 4 is a top elevational view of the pump of FIG. 1 taken along lines 4—4 of FIG. 3.
Figure 3:
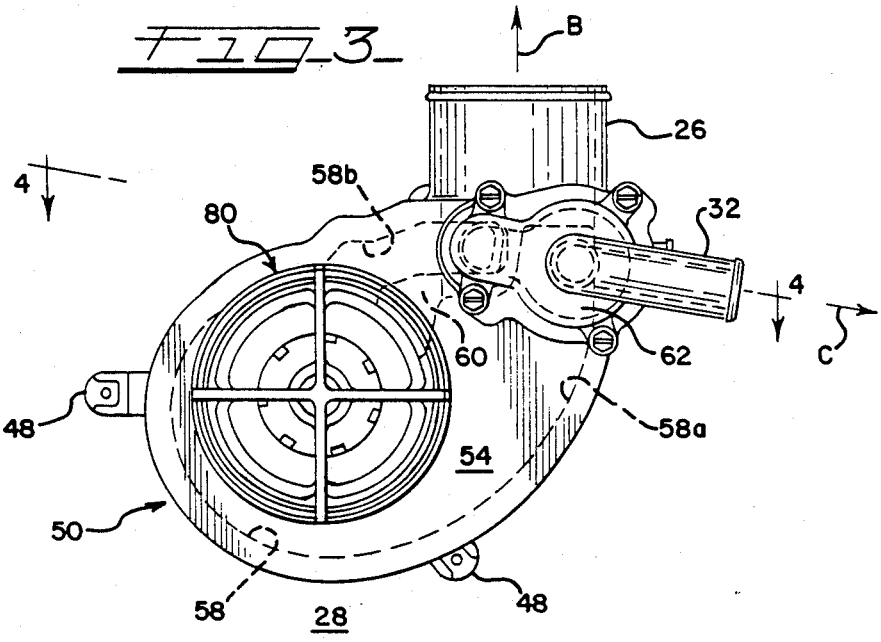
FIG. 3 is an elevational inlet end view of the pump of FIG. 1 taken along lines 3—3 of FIG. 2.

As viewed in FIG. 3, when the impeller 42 is driven to rotate in a counterclockwise direction, washing and rinsing liquids pass into the large outlet section **58*a* and up the large outlet 26 into the column of the rotary spray arm assembly 30 for washing or rinsing items in the dishwasher 10. When the impeller 42 is rotated in a clockwise direction (FIG. 3), the liquids to be discharged flow into the small outlet passage 58*b* which is separated from the larger passage 58*a* by a divider 60. In the latter mode of operation, the liquids pass into an outlet housing 62, which encloses a diaphragm valve assembly 64 (FIG. 4), in communication with the drain outlet 32** for discharging liquids therethrough (arrow C, FIG. 3).

An outer end portion of the motor shaft 40 is formed with flat surfaces **40*a* on opposite sides thereof to provide a keyed, driving engagement with an elongate, outwardly extending, hollow tubular central hub 42*a* of the impeller 42. A bore 65 of the tubular hub 42*a* has mating, elongate, internal flattened surfaces 65*a* to drivingly engage the surfaces 40*a* of the shaft 40 (FIG. 2A). The impeller 42 is thus keyed to rotate with the shaft 40 in either direction, but also is movable longitudinally along the shaft 40 (arrow D, FIG. 2). This arrangement enables the impeller 42 to be inserted onto the shaft 40 during final assembly of the pump 28 from the inlet side of the pump housing 50**.

The impeller 42 is formed of a moldable plastic material, such as a modified polyphenylene oxide, that is strong, lightweight and corrosion resistant. The impeller 42 includes a radially, outwardly extending cylindrical plate or disk **42*b* (FIG. 5) that is integrally joined with the outwardly extending, tubular, hollow hub 42*a*. A plurality of spirally arranged impeller blades 42*c* having thickened radially inwardly directed ends are integrally formed on the plate 42*b* to force the liquids outwardly towards the periphery of the involute chamber 58 when the impeller 42** rotates.

The impeller 42 also includes an annular recess **42*d* (FIG. 2) around the bore 65 for receiving an outer end portion of a seal head assembly 66. The assembly 66 includes an internal compression spring 68 having an outer end disposed in the recess 42*d* for biasing the impeller 42 axially outwardly (arrow D, FIG. 2) on the shaft 40 in the direction of the inlet side of the pump 28. The assembly 66 (FIG. 5) includes an outwardly extending, flexible, annular sealing element 69 formed of resilient material, such as Buna N rubber, and having a plurality of annular sealing ribs 66*a* adapted for forming a sealing engagement with and against the adjacent surface of the recess 42*d* of the impeller 42. An enlarged portion 69*a* (FIG. 5) of the sealing element 69 is contained within an annular, metal retaining ring 70 disposed about an annular rigid spacer ring 72 formed of rigid material and mounted on a hollow sleeve 74 carried on the shaft 40**.

An annular seat seal assembly 76 (FIG. 2) is mounted in a recess 77 provided around the shaft 40 and formed in the innermost or base section 52 of the pump housing 50. The seal head assembly 66 and the seat seal assembly 76 cooperate to provide a water-tight seal between the rotating shaft 40 and the pump housing 50 and to bias the impeller 42 axially outwardly on the shaft 40 (as indicated by the arrow D) in the direction of the inlet end of the pump housing 50.

Figure 2B:
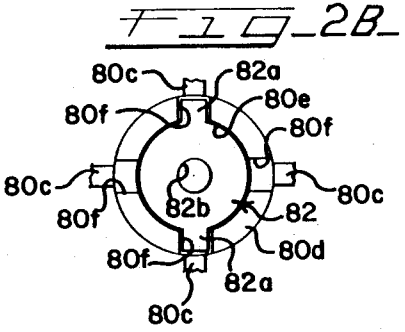
FIG. 2B is a cross-sectional view, taken along lines 2B—2B of FIG. 2, of a portion of the pump of FIG. 1.
Figure 2A:
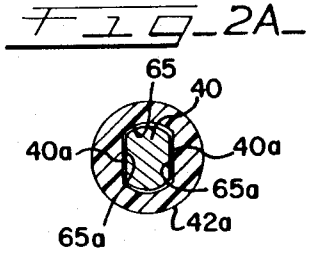
FIG. 2A is a cross-sectional view, taken along lines 2A—2A of FIG. 2, of a portion of the pump of FIG. 1; side of a recirculatin
Figure 2:
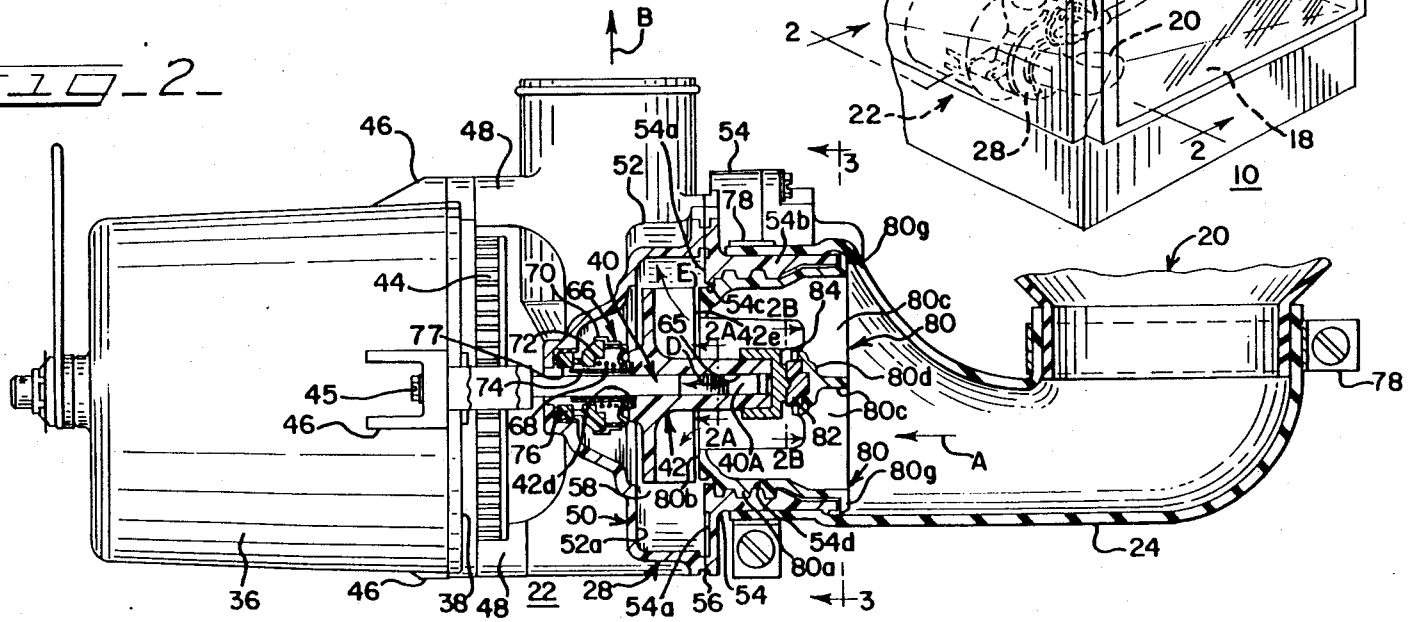
FIG. 2 is an enlarged side elevational view, taken along lines 2—2 of FIG. 1, of the pump of FIG. 1.

The innermost wall section 52 of the pump housing 50 includes an outwardly projecting annular radial wall segment or face **52*a* spaced closely adjacent to the inner or back side of the impeller disk 42*b* as shown in FIG. 2. A similar annular radial wall segment or face 54*a* (FIG. 2) spaced outwardly of the shaft 40 is formed in the member 54 in a spaced apart axial direction from the opposite face 52*a* on the inlet section 52 of the pump housing 50. The annular faces 52*a* and 54*a* thus provide spaced apart, annular side walls of the involute impeller chamber 58 on opposite sides of the rotating impeller 42**.

In order effectively to collect the liquids directed radially outwardly of the shaft 40 by the rotating impeller 42 and the impeller blades **42*c*, the spacing between surfaces 52*a* and 54*a* of the pump housing 50 is greater than the width of the impeller 42. Thus, a limited amount of axial shifting of the impeller on the shaft 40 is accommodated without interference against the wall surfaces 52*a* and 54*a***.

The section 54 of the pump housing 50 is formed with a generally cylindrical, inlet portion **54*b* projecting outwardly in an axial direction towards the incoming flow of liquids received from the inlet conduit 24. The conduit 24 is secured about the outer surface of the portion 54*b* by a removable hose clamp 78. A similar hose clamp may be used to detachably clamp the upwardly facing inlet end of the inlet conduit 24 to the drain sump fitting 20 on the bottom wall 18 of the washing chamber 16. The radial face 54*a* of the housing section 54 is formed with an enlarged diameter, circular inlet opening 54*c* having a diameter slightly greater than the maximum outer diameter of the impeller plate 42*b* so that the impeller 42 can freely move into and out of the interior of the pump chamber 50** during assembly and later during disassembly if servicing is needed.

The internal surface of the cylindrical inlet portion **54*b* is provided with helical threads 54*d* for threaded engagement with external threads 80*a* provided on the outer surface of a bearing mount 80. The bearing mount 80 is preferably formed of molded resinous plastic material, such as a modified polyphenylene oxide, as used for the impeller 42. At its inner end, the bearing mount 80 is formed with a radially extending annular face 80*b* which projects radially inwardly to partially close the opening 54*c* near the outer edges 42*e* of the whirling impeller blades 42*c*. The pump 28 is most efficient in operation when a precise clearance or gap E (FIG. 2) is established between the edges 42*e* (FIG. 5) of the blades 42*c* and the face 80*b*. The clearance or gap E is measured in a direction parallel to the longitudinal axis of the shaft 40. If the gap E is too small, the face 80*b* may contact the edges 42*e* of the blades 42*c*; and damage to the pump 28 may result. If the gap E is too large, the efficiency of the pump 28 is diminished. The preferred gap E for a pump 28 of a particular size is found by experimentation; and, once established, it is preferred that the gap E have minimal tolerance factors during the final assembly of pumps 28 of the same type and size in order to maximize pump efficiency during operation for each such pump 28**.

The bearing mount 80 includes a plurality of elongate, integrally molded radial fins **80*c* that extend radially inwardly to support a central, bearing support block 80*d* (FIG. 2B). The support block 80*d* includes a cylindrical recess 80*e* coaxially aligned with the shaft 40**.

Around the outer edge of the support block **80*d* are a plurality of radial, key slots 80*f* adapted to receive opposite ears or keys 82*a* provided on a replaceable thrust bearing 82 formed of a low friction, high strength material, such as graphite reinforced with a phenolic resin. The generally circular outer face of the replaceable thrust bearing 82 is formed with a shallow central recess 82*b* that receives and supports an outwardly projecting boss 84*a* (FIG. 5) provided at the center of an outer end wall 84*b* of a bearing cap 84, perferably formed of a low friction material, such as sintered bronze. The bearing cap 84 includes an annular side wall 84*c* fixedly secured to the outer end portion of the tubular hub 42*a* of the impeller 42**.

The engagement between the bearing cap 84 and the thrust bearing 82 provides radial support for the longitudinal ends of the shaft 40 and of the impeller 42 nearest the inlet side of the pump 28. In addition, the face **84*b* of the bearing cap 84 engages the facing surface of the thrust bearing 82 which serves as a stop surface for limiting the axial movement of the impeller 42 along the shaft 40 under the bias of the spring 68 of the seal head assembly 66. When the bearing mount 80 with the thrust bearing 82 mounted therein is fully threaded into the cylindrical inlet portion 54*b* of the pump housing 50, the desired amount of clearance E is automatically established with minimal tolerance stackups, because the distance E is determined only by the variences in mount 80 and impeller 42. The bearing mount 80 is fully assembled in its final desired operating position when bearing mount threads 80*a* bottom against inlet section lip 54*c* (FIG. 2). This engagement automatically determines the clearance E between the face 80*b* of the bearing mount 80 and the radial edges 42*e* of the impeller blades 42*c***.

To assemble the pump assembly 22, the motor 36 and the pump 28 are secured together by the fasteners 45 with the shaft 40 projecting into the interior of the pump housing 50. The annular seat seal 76 is moved along the shaft 40 and is seated in the central recess 77. The annular seal head assembly 66 is then placed on the shaft 40 and is moved therealong until it rests against the seat seal 76. Subsequently, the impeller 42 is placed on the shaft 40 and is moved therealong until it engages the seal head assembly 66.

The bearing mount 80 with the thrust bearing 82 carried therein is then threaded into the inlet section **54*b* until the threads 80*a* bottom against inlet section lip 54*c* (FIG. 2). When this contact occurs, the inwardly facing surface of the thrust bearing 82 engages the face 84*a* of the bearing cap 84; and the impeller 42 is, thereby, automatically positioned along the length of the shaft 40 with the desired clearance E between the inwardly directed radial face 80*b* of the bearing mount 80 and the edges 42*e* of the impeller blades 42*c***.

For service or replacement of the seal seat 76, the seal head assembly 66, the impeller 42 or the thrust bearing 82, after the inlet conduit 24 has been removed, the bearing mount 80 is unthreaded so that any one or more of the above components can be withdrawn.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. An automatic dishwasher comprising an interior washing chamber, a pump assembly for pumping liquids into and out of said washing chamber, said pump assembly including a motor having a rotatable motor shaft and a pump having both a pump housing and a rotatable impeller disposed in said housing, said motor shaft extending into said pump housing and said impeller being disposed along and axially movable along the length of said motor shaft and being configured to be engaged and rotatably driven by said motor shaft, and wall means removably securely engaging said pump housing at an inlet end of said pump housing for providing a radially outwardly extending wall surface spaced from said impeller to provide a desired amount of clearance therebetween, the amount of said clearance being determined by the engagement of said pump housing and said wall means.

2. An automatic dishwasher as recited in claim 1 wherein said wall means is configured to enable said liquids to flow into said pump and to contact said impeller.

3. An automatic dishwasher as recited in claim 1 wherein said pump further includes a thrust bearing means for supporting said impeller and for limiting the axial movement of said impeller along the length of said motor shaft and wherein said wall means further includes support means for mounting and supporting said thrust bearing means in said pump.

4. An automatic dishwasher as recited in claim 3 further comprising resilient means for biasing said impeller for axial movement along the length of said motor shaft in the direction of said thrust bearing means, the bias force of said resilient means being counteracted by said thrust bearing means and said support means.

5. An automatic dishwasher as recited in claim 4 wherein said wall means is configured threadedly to engage a complementarily shaped portion of said pump housing.

6. An automatic dishwasher as recited in claim 5 wherein said wall means further comprises means for limiting the movement of said wall means within said pump housing.

7. An automatic dishwasher comprising a pump assembly for pumping liquids into and out of said dishwasher comprising an electric motor having a rotatable motor shaft and a dishwasher pump, said pump having a pump housing and a first wall, said rotatable shaft extending into said housing through said first wall, said pump further including a second wall, formed partially by said pump housing, spaced from said first wall, a rotatable impeller disposed in said housing between said first and second walls along the length of said motor shaft and configured both to be driven by said motor shaft and to be capable of axial movement along the length of said motor shaft, said second wall including an adjustable wall portion configured to form a selected value of clearance between said impeller and said adjustable wall portion, and means for removably securely positioning said adjustable wall portion in said pump.

8. An automatic dishwasher as recited in claim 7 wherein said positioning means further includes limit means for maintaining the position of said impeller between said first and second walls and for limiting the axial movement of said impeller along the length of said motor shaft.

9. An automatic dishwasher as recited in claim 8 wherein said limit means further includes a thrust bearing and means for mounting said thrust bearing within said pump to maintain the position of said impeller between said first and second walls while enabling the rotation of said impeller by said motor shaft.

10. An automatic dishwasher as recited in claim 9 wherein said positioning means further comprises integrally formed stop means for contacting said pump housing to fix the position of said limit means within said pump housing.

11. An automatic dishwasher as recited in claim 10 further comprising means for biasing said impeller in a direction away from said first wall towards the inlet side of said pump, the force of said biasing means being counteracted by said limit means to position said impeller at a predetermined location within said pump.

12. A method of assembling an automatic dishwasher pump of the type including a pump housing having first and second spaced apart walls with an aperture formed through said first wall for receipt of a rotatable motor shaft therethrough and also including an impeller disposed about and axially movable along the length of said motor shaft and configured to be rotated by said motor shaft, comprising the steps of forming said second wall with an aperture coaxially aligned with said motor shaft and configured to enable said impeller to move thereby along the length of said motor shaft, positioning said impeller onto said shaft from outside said pump housing, moving said impeller axially along said shaft such that at least a portion of said impeller passes through said aperture in said second wall, enclosing an annular portion of said aperture in said second wall by removably securely attaching a removable wall member to said pump and adjusting the position of said removable wall member axially along the length of said shaft to provide a desired clearance between said removable wall member and said impeller, thereby to provide for the efficient operation of said pump.

13. A method of assembling an automatic dishwasher pump as recited in claim 12 further comprising the step of configuring a portion of said pump housing and said removable wall member with complementarily shaped threads to enable the threaded engagement of said removable wall member with said pump housing, said adjusting step comprising the step of rotating said removable wall member with respect to said pump housing thereby to adjust the receipt of said removable wall member within said pump housing until said desired clearance is achieved.

14. A method of assembling an automatic dishwasher pump as recited in claim 13 further comprising the step of limiting the axial movement of said impeller along the length of said motor shaft to maintain said desired clearance.

15. A method of assembling an automatic dishwasher pump as recited in claim 14 wherein said limiting step includes the step of biasing said impeller for movement axially along the length of said motor shaft and of counteracting said biasing by means of said removable wall member to maintain said desired clearance.

16. A method of disassembling an automatic dishwasher pump of the type having a pump housing having first and second spaced apart walls and a rotatable motor shaft extending through said first wall and an impeller mounted on said motor shaft and axially movable along the length of said motor shaft and keyed to rotate with said motor shaft, said second wall including an aperture configured to enable said impeller to pass therethrough, and a removable wall member disposed within said aperture forming a portion of said second wall spaced from said impeller by a desired clearance, comprising the steps of removing said removable wall member from the interior of said pump to the exterior thereof through an inlet side of said pump and subsequently removing said impeller from said pump by axially moving said impeller along the length of said motor shaft in the direction of the inlet side of said pump.

17. A method of disassembling an automatic dishwasher pump as recited in claim 16 wherein said step of removing said wall member comprises the step of rotating said wall member with respect to said housing to effect the threaded disengagement of said removable wall member from said pump housing.

* * * * *